US011480039B2

(12) United States Patent
Beck et al.

(10) Patent No.: US 11,480,039 B2
(45) Date of Patent: Oct. 25, 2022

(54) DISTRIBUTED MACHINE LEARNING CONTROL OF ELECTRIC SUBMERSIBLE PUMPS

(71) Applicant: Halliburton Energy Services, Inc., Houston, TX (US)

(72) Inventors: David C. Beck, Broken Arrow, OK (US); Luke Golden Janger, Tulsa, OK (US); Donn J. Brown, Broken Arrow, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 147 days.

(21) Appl. No.: 16/494,972

(22) PCT Filed: Dec. 6, 2018

(86) PCT No.: PCT/US2018/064327
§ 371 (c)(1),
(2) Date: Sep. 17, 2019

(87) PCT Pub. No.: WO2020/117252
PCT Pub. Date: Jun. 11, 2020

(65) Prior Publication Data
US 2021/0071508 A1 Mar. 11, 2021

(51) Int. Cl.
*E21B 43/12* (2006.01)
*F04B 49/06* (2006.01)
(Continued)

(52) U.S. Cl.
CPC ..... *E21B 43/128* (2013.01); *F04B 17/03* (2013.01); *F04B 47/00* (2013.01); *F04B 49/065* (2013.01)

(58) Field of Classification Search
CPC ..... F04B 49/065; F04B 49/06; F04B 49/00; F04B 47/00; F04B 17/03; F04B 49/22;
(Continued)

(56) References Cited

U.S. PATENT DOCUMENTS 6,873,267 B1 * 3/2005 Tubel ..... E21B 43/12 166/250.15
6,947,870 B2 9/2005 Zhu et al.
(Continued)

FOREIGN PATENT DOCUMENTS

KR 1020150131602 A1 11/2015
WO 2016182558 A1 11/2016

OTHER PUBLICATIONS

PCT Application Serial No. PCT/US2018/064327, International Search Report, dated Aug. 26, 2019, 3 pages.
(Continued)

*Primary Examiner* — Dominick L Plakkoottam
(74) *Attorney, Agent, or Firm* — Delizio, Peacock, Lewin & Guerra

(57) ABSTRACT

A motor of an electric submersible pump (ESP) is positioned in a wellbore. Measured data is received from one or more sensors. A first deep learning model running on a motor controller of the ESP determines first operating parameters or first operating conditions for the ESP based on the measured data. The motor controller sends the first operating parameters or first operating conditions to a centralized computer system. A second deep learning model running on the centralized computer system determines second operating parameters or second operating conditions associated with the ESP based on the first operating parameters or first operating conditions. The centralized computer system sends the second operating parameters or second operating conditions to the motor controller. The motor controller
(Continued)

adjusts operation of the motor of the ESP based on the second operating parameters or second operating conditions.

20 Claims, 10 Drawing Sheets

(51) Int. Cl.
*F04B 47/00* (2006.01)
*F04B 17/03* (2006.01)

(58) Field of Classification Search
CPC ..... F04B 49/20; F04B 51/00; H02P 29/00; E21B 43/128; E21B 43/12; E21B 43/26; F02B 63/04
See application file for complete search history.

(56) References Cited

U.S. PATENT DOCUMENTS

2003/0015320 A1* 1/2003 Crossley ..... E21B 47/008 166/250.15
2005/0173114 A1* 8/2005 Cudmore ..... E21B 47/008 166/250.15
2013/0175030 A1* 7/2013 Ige ..... G05D 7/0676 700/282
2015/0241881 A1* 8/2015 Ige ..... E21B 43/128 700/282
2016/0314409 A1* 10/2016 Bittencourt ..... G05B 13/0265
2017/0033729 A1 2/2017 Matsumoto et al.
2017/0089192 A1* 3/2017 Rendusara ..... F04D 13/10
2017/0328194 A1* 11/2017 Liu ..... G06N 3/088
2018/0087360 A1* 3/2018 Conn ..... G06N 3/04
2018/0306693 A1* 10/2018 Nazari ..... G01N 33/2847
2018/0307286 A1 10/2018 Jahagirdar et al.
2019/0331513 A1* 10/2019 Jalilian ..... G06N 3/08
2021/0222552 A1* 7/2021 Gao ..... E21B 47/00

OTHER PUBLICATIONS

PCT Application Serial No. PCT/US2018/064327, International Written Opinion, dated Aug. 26, 2019, 8 pages.

* cited by examiner

DISTRIBUTED MACHINE LEARNING CONTROL OF ELECTRIC SUBMERSIBLE PUMPS

TECHNICAL FIELD

The disclosure generally relates to the field of artificial lift systems, and more particularly to controlling operation of electric submersible pumps (ESP) using deep learning models.

BACKGROUND ART

Electric submersible pumps, also known as ESPs, are typically installed in wellbores to access fluids such as hydrocarbons located underground in a reservoir. The ESP is an efficient and reliable artificial-lift method for lifting moderate to high volumes of fluids from a geologic formation through wellbores to the surface. The ESP is typically coupled to a motor controller having a programmable logic controller (PLC) for controlling operation of the ESP.

Various sensors are positioned throughout the wellbore and surface to measure conditions in the wellbore to facilitate control of the ESP. Outputs of the sensors are sent to a centralized location for analysis by engineering personnel who then make decisions regarding the operation of the ESP. For example, sensors are arranged to detect gas bubbles in the fluid being pumped by the ESP. Upon this detection, engineering personnel would conclude that the gas bubbles reduce efficiency of the ESP and heat transfer from a motor of the ESP to the fluid, increasing chances for the motor to overheat and stop pumping fluid. The engineering personnel mitigates this risk by having the motor controller reduce the speed of the motor to reduce the risk of overheating while the gas bubbles work its way through the ESP. In this regard, the output of the sensors need continual monitoring so that ESP operation can be adjusted to maintain a desired fluid production.

BRIEF DESCRIPTION OF THE DRAWINGS

Embodiments of the disclosure may be better understood by referencing the accompanying drawings.

Figure 1:
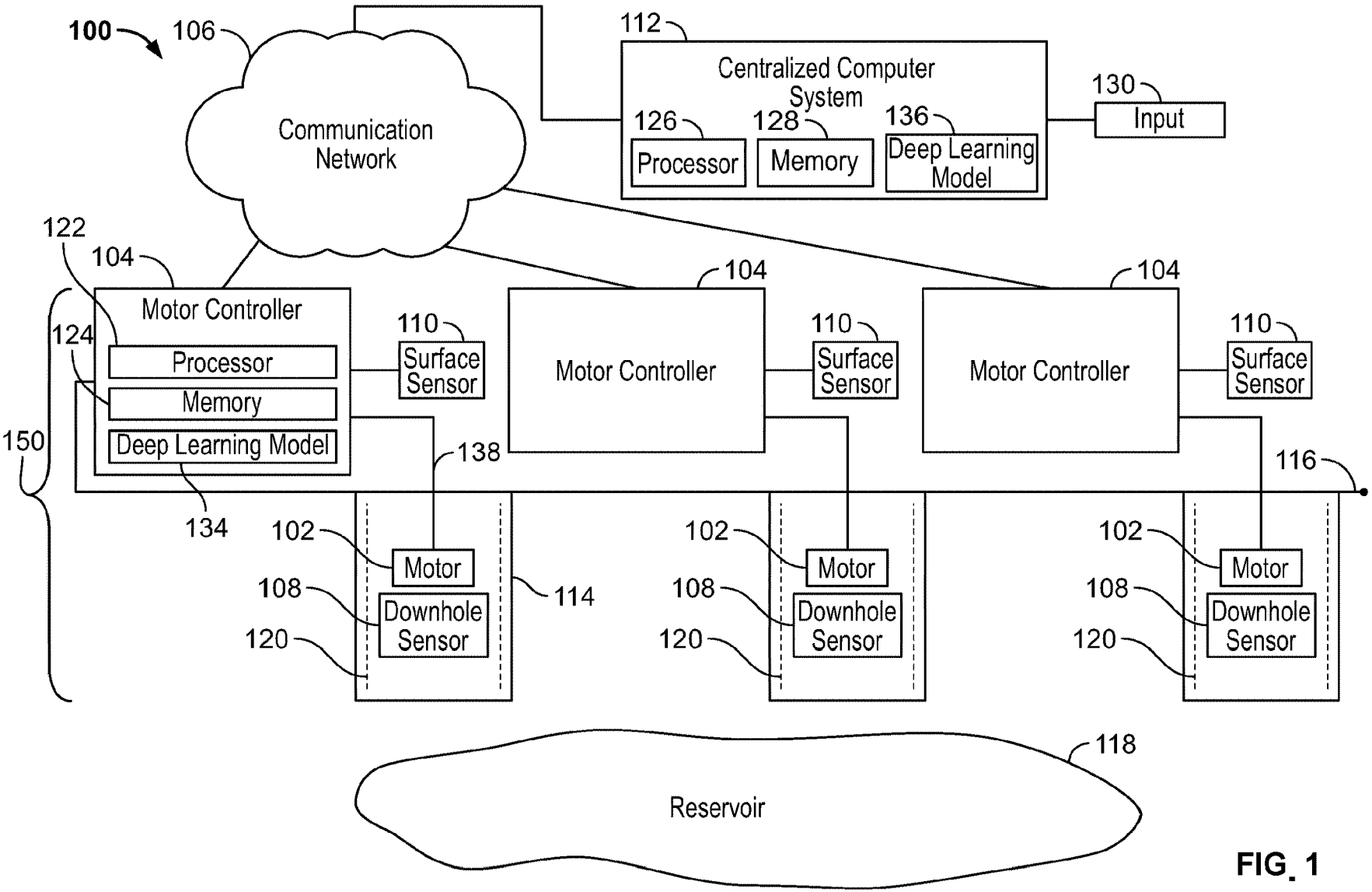
FIG. 1 illustrates an example of a well system for controlling extraction of fluids such as hydrocarbons from a geologic formation.

The drawings are for purpose of illustrating example embodiments, but it is understood that the inventions are not limited to the arrangements and instrumentalities shown in the drawings.

DESCRIPTION OF EMBODIMENTS

The description that follows includes example systems, methods, techniques, and program flows that embody embodiments of the disclosure. However, it is understood that this disclosure may be practiced without these specific details. For instance, this disclosure refers to control of electric submersible pumps (ESP) using deep learning models in illustrative examples. Embodiments of this disclosure can be also be applied to control of other well apparatus. In other instances, well-known instruction instances, protocols, structures and techniques have not been shown in detail in order not to obfuscate the description.

Overview

Embodiments described herein are directed to centralized and distributed control of electric submersible pumps (ESP) in a wellbore using a deep learning model associated with one or more of a motor controller of an ESP and centralized computer system. The deep learning model allows for intelligent control of the ESP to meet fluid production goals of the wellbore and well system while reducing downtime due to failure or shutdown of the ESP.

In centralized control, a deep learning model associated with a motor controller of an ESP receives various inputs. The various inputs include one or more of operating conditions, application input, supervisory input, model inputs, and a goal set associated with fluid production from the geologic formation. The deep learning model models flows and geologic properties of a specific well and/or determines operating parameters or operating conditions for a specific type ESP. The deep learning model outputs one or more of operating conditions in and around the ESP, operating parameters associated with a motor, and a classification state of the ESP based on the various inputs. A centralized computer system receives the outputs of the deep learning model associated with the motor controller. The outputs are input into a reservoir model associated with the centralized computer system.

The reservoir model is a mathematical model of fluid flows and geologic properties of a plurality of wellbores in which the ESPs are deployed and flows and properties of reservoir rocks that connect those wellbores. Based on the received outputs of the deep learning model associated with the motor controller of the ESP, the reservoir model outputs one or more of operating conditions in and around the ESP, operating parameters, and a classification state of the ESP. The output from the reservoir model is provided to the motor controller which adjust operation of a motor of the ESP to control pumping of fluid by the ESP to meet fluid production objectives. By the centralized computer system determining one or more of the operating conditions, operating parameters, and classification state, the computational loads on each motor controller is reduced. The centralized control also allows for intensive computations associated with determining one or more of the operating conditions, operating parameters, and classification state being performed on the centralized computer system which is more capable than the motor controller. Also, the centralized control allows for accurate control of the ESPs to achieve reservoir fluid production goals. The centralized control controls an ESP based on knowledge of the reservoir and how decisions with respect to fluid production of one wellbore will affect fluid production goals of another wellbore to achieve the reservoir fluid production goals.

In distributed control, each of the motor controllers may have a submodel. The submodel is a deep learning model corresponding to a portion of a reservoir model. The submodel models fluid flows and geologic properties of a respective wellbore. Unlike the deep learning model running on the motor controller in centralized control, the submodels have mathematical properties such that the modeling is optimized for the respective wellbore with minimal input from the other portions of the reservoir and then the separate optimizations can be combined to form a single optimization of the entire reservoir. The single optimization in some cases may be equivalent to the reservoir model.

The submodel may receive one or more of operating conditions, application input, supervisory input, model inputs, and a goal set and outputs one or more of operating conditions of the wellbore and/or ESP, operating parameters, and a classification state of the ESP. The motor controller may use the output of the submodel to adjust operation of a motor associated with the ESP.

The distributed control provides fault tolerance compared to the centralized control which relies on reliable operation of the central computer system. Failure of one motor controller will still allow control of the other ESPs. The distributed control also provides quicker response time since control decisions are being performed on the ESP rather than centralized computer. The distributed control also uses less bandwidth since less communication to a centralized computer system is needed to control the ESP. The submodel associated with a given motor controller can also be updated by the centralized computer system, the given motor controller, or another motor controller, due to changes in well conditions resulting in fine grained control of the ESP.

The description that follows includes example systems, apparatuses, and methods that embody aspects of the disclosure. However, it is understood that this disclosure may be practiced without these specific details. In other instances, well-known instruction instances, structures and techniques have not been shown in detail in order not to obfuscate the description.

Example Illustrations

FIG. 1 illustrates an example of a well system 100 for controlling extraction of fluids such as hydrocarbons from a geologic formation. The system includes a plurality of electric submersible pumps 150 (ESPs), a communication network 106, a plurality of sensors 108, 110, and a centralized computer system 112.

The ESP 150 is an efficient and reliable artificial-lift system for lifting moderate to high volumes of fluids from a geologic formation through wellbores 114 to the surface 116. Each ESP 150 includes a variable speed motor 102 such as an AC induction motor coupled to a pump that produces the artificial lift. The motor 102 may be installed downhole in the wellbore 114 while a motor controller 104 for controlling the motor 102 may be located at the surface 116 of the geologic formation. The geologic formation may contain a reservoir 118 of fluid such as hydrocarbons. The motor controller 104 coupled to the ESP 150 controls operation of the ESP 150 by communicating control signals to the motor 102 to run the pump, stop the pump, and/or control a speed of the pump and thus control flow rate of fluid through the pump.

The fluid may be pumped via a fluid column such as tubing 138 in the wellbore 114 to the surface 116. The wellbore 114 is typically lined with a casing 120 such as a steel or cement pipe which prevents the wellbore 114 from caving in, among other purposes. The casing 120 may have one or more perforations which allows the fluid in the reservoir 118 to flow into the wellbore 114. The pump coupled to the motor 102 consists of a series of impellers in contact with the fluid in the casing or liner 120 such that rotation of the motor 102 causes the pump to generate artificial lift which pumps the fluid from the reservoir 118 to the surface 116 via the tubing 138.

The well system 100 also includes one or more sensors 108, 110, which can take the form of downhole sensors 108 and surface sensors 110. The downhole sensors 108 may provide real-time measurement data associated with operating conditions downhole. For example, the downhole sensors 108 may provide measurement data related to operating conditions downhole in and around the ESP 150 such as vibration, ambient wellbore fluid temperature, ambient wellbore fluid pressure, flow rate, density, pressure, torque, power and/or measurement data relating to equipment conditions such as motor oil pressure, motor oil temperature, pump intake pressure, fluid pressure at one or more stages of the pump, fluid temperature at one or more stages of the pump, pump output pressure, pump output flow rate, pump output fluid temperature, and the like. The surface sensors 110 may provide real-time measurement data related to operating conditions at the surface 116 such as vibration, ambient wellbore fluid temperature, ambient wellbore fluid pressure, flow rate, gas chromatography, fluid level, and the like. The well system 100 may have other sensors as well. In one or more examples, the operating condition may be determined based on the measurement data. In other cases, the sensors 108, 110 may measure the operating condition directly and output an indication of the operating condition.

The centralized computer system 112 may be one or more systems located at the surface 116 which facilitate control the ESPs 150. The centralized computer system 112 may be coupled to an input 130 such as a database or a user interface (e.g., display and/or input/output device such a keyboard, mouse, etc.) which allows for providing input associated with control of the ESP 150 by engineering personnel. One or more of the motor controller 104 and centralized computer system 112 have a respective processor 122, 126, memory 124, 128, and deep learning model 134, 136. The processor 122 may be less powerful than the processor 126 which allows the centralized computer 112 to perform more complex calculations than the motor controller 104. The memory 124 may be smaller than the memory 126 which allows the centralized computer 112 to store more data than the motor controller 104. The processors and memories may take other forms as well.

The deep learning model 134, 136 is a neural network which has a certain topology for modeling behavior of the well system 100 (or wellbores 114 in the well system 100) based on variables which might or might not be directly measurable by the sensors 108, 110, non-linearities and chaotic behaviors in the well system 100. The deep learning model 134, 136 may be classified as multi-layer kernel machines, deep belief networks, deep Boltzmann machines, neural Turing machines, differential neural computers, compound deep coding networks using Q-networks, memory networks, or pointer networks, Markov models, deep model, deep architecture, deep neural network, computational model, among others.

The deep learning model uses a cascade of multiple layers of nonlinear processing units (e.g., states or nodes) that are connected together by weighted branches, where each successive layer uses the output from the previous layer as input. In deep learning, each level transforms its input data into a slightly more abstract and composite representation by the weighted branches. The "deep" in "deep learning" refers to more than two hidden layers through which the data is transformed from input layer to output layer based on the nonlinear processing units and weighted branches. The hidden layer is in between input layers and output layers, where the input layer and output layer are coupled to the input and output respectively. Deep learning models are distinguishable from neural network models in that the neural network models provide a non-parametric framework for representing a non-linear functional mapping between an input and an output space consisting of no more than one or two hidden layers and fewer states or nodes than the deep learning model.

In this regard, the deep learning model 134, 136 facilitates intelligent control of the ESP 150 to meet fluid production goals of the wellbore 114 and well system 100 while reducing downtime due to failure or shutdown of the ESP 150. More than two hidden layers allows the deep learning model to accurately model transient equipment conditions and/or downhole conditions associated with wellbore. This way the output of the deep learning model can be used to control the ESP in real time and/or accurately determine downhole conditions based on the real time measurement data (which may also be transient) input into the model. Further, using deep learning models to control the ESP also reduce the required amount of preprocessing of input into the deep learning model and post processing of output of the deep learning model, as much of those operations can now be trained into the deep learning model because of a greater number of available states for representation rather than having a separate preprocessing module coupled to an input of the neural network model and a separate post processing module coupled to an output of the neural network model. To illustrate, sensor data for each well may need to be preprocessed prior to input to a neural network models because the sensor output measuring same operating conditions may vary. The preprocessing may be a normalization (e.g., adjusted to a common scale) process prior to input into the neural network model, e.g., convert pressure deviations to percentages of average well pressures prior to input into a neural network model. With deep learning models, the pressure deviations can be fed directly into deep learning networks without normalization. The deep learning algorithms can process unnormalized data due to their better ability to represent a well system in part because it uses a larger number of states compared to neural network models.

The communication network 106 may be one or more of a wired and/or wireless network. The motor controller 104 may communicate data with the centralized computer system 112 via the communication network 106. Additionally, each motor controller 104 may be arranged to communicate data with another motor controller 104 via the communication network 106.

Figure 2:
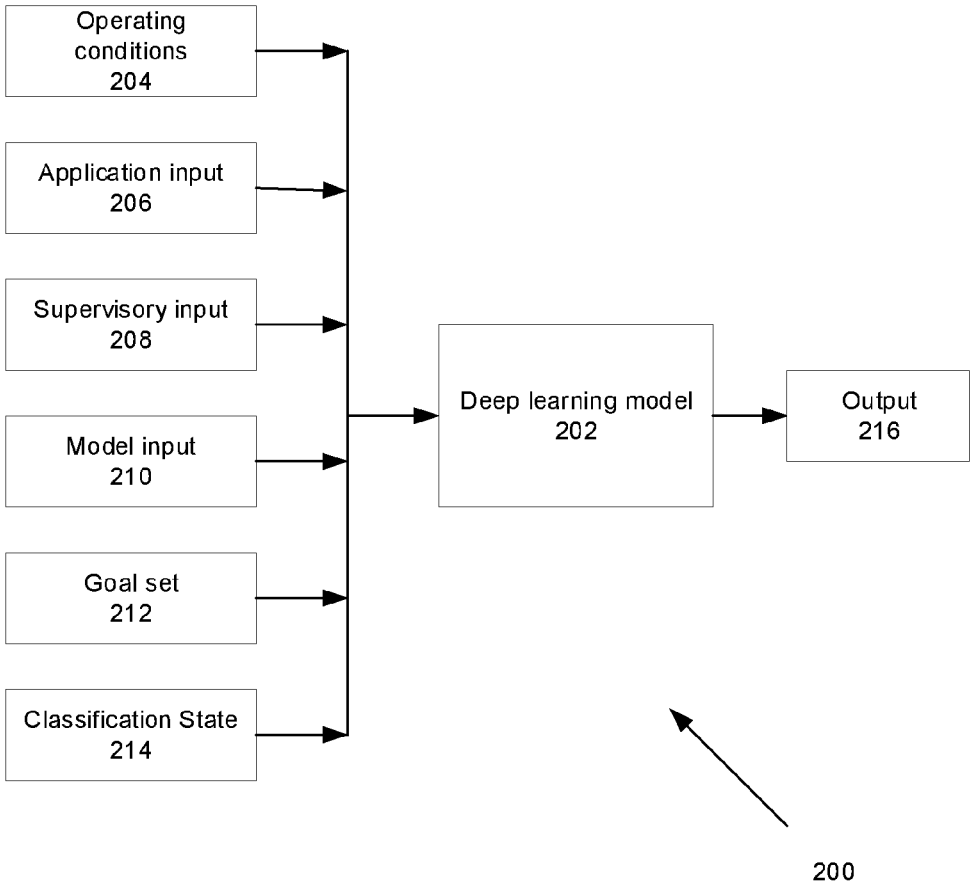
FIG. 2 is a block diagram associated with operation of a deep learning model.

FIG. 2 is a block diagram 200 associated with operation of a deep learning model 202. The deep learning model 202 may receive one or more inputs including operating conditions 204, application input 206, supervisory input 208, model inputs 210, a goal set 212, a classification state 214, or some other input and generate an output 216.

The well system includes one or more sensors which can take the form of the downhole sensors and the surface sensors. Measurement data output by the sensor is in turn provided as input into the deep learning model 202 as operating conditions 204. The operating conditions 204 may describe the environment in which the ESP is operating based on measurements by the sensors. The operating conditions 204 may include actual and stored operating conditions. The actual operating conditions may be based on output of sensors in the wellbore determined in real time. The stored operating conditions may be based on output of sensors in the wellbore received at some earlier time and stored for subsequent input into the deep learning model 202.

The application input 206 and supervisory input 208 are received by the centralized computer system and provided to the deep learning model 202. The application input 206 may be indicative of an environment in which the ESP is operating. The application input 206 may identify one or more of well casing sizes, well equipment type and diameter, known formation pressures, well depth and well equipment set depth, and other information about the environment in which the ESP is operating. The application input 206 may be provided to the centralized computer system via an external source such as a database or by engineering personnel via a user interface to the centralized computer system (e.g., display and/or input/output device such a keyboard, mouse, etc.) that receives input from the engineering personnel. The supervisory input 208 may be input from engineering personnel to the centralized computer system. The supervisory input 208 may be an indication such as a classification state of an ESP, e.g., gas locked, running normally, shut down, etc. Examples of the supervisory input 208 may also include an indication of health of an ESP by engineering personnel. The ESP may be characterized as being healthy or unhealthy. A healthy state may indicate that the ESP is operating within normal operating conditions while an unhealthy state may indicate that the ESP is not operating within normal operating conditions. The normal operating conditions may be determined based on the engineering personnel analyzing measurement data. If a given measurement data is not outside an acceptable range, then the ESP may be operating within normal operating conditions and be healthy. If a given measurement data is outside an acceptable range, then the ESP may not be operating within normal operating conditions and be unhealthy. As another example, the supervisory input 208 may take the form of an estimate of fluid flow in the wellbore based on human observation of the measurement data received at the centralized computer system. An indication of the supervisory input 208 is provided to the deep learning model. Other examples are also possible.

The model input 210 may be an output from a deep learning model (which may be the same or different as the deep learning model 202). The output may be an operating condition which is provided as a model input 210. Alternatively, the output may be an operating parameter as described in further detail below which is provided as a model input 210.

As another example the model input 210 may be from an output of a mathematical model derived from theoretical or empirical knowledge of the operating conditions in the wellbore. This model input 210 may take the form of output from a virtual sensor with readings generated by the mathematical model. The virtual sensor may allow for making measurements which otherwise might be difficult to measure with physical sensors (e.g., inaccessible locations in the wellbore) such as flow rates at a well head of the wellbore or deep underground. In one example, the mathematical model may be a model of fluid flowing in the wellbore running on the motor controller or centralized computer system. The fluid in the reservoir may be a single phase such as fluid or a multiphase fluid such as fluid and gas. In the case that the fluid is a multiphase fluid, the flow rate of the fluid may be modeled by the mathematical model as a spring and damping function instead of directly measured due to cost of instrumentation and/or the effects of gas bubble collapse on action of a Coriolis flow meter. Measurement data from available sensors may be input into the mathematical model. An output of this mathematical model (i.e., output of the virtual sensor) may be input into the deep learning model as the model input 210. The output may be a fluid flow rate of the multiphase fluid. As another example, the model input 210 may be an output from a deep learning model associated with another ESP. For example, an operating parameter or operating condition of the other ESP may be determined via its own deep learning model and provided to the ESP as an input into the deep learning model 202. As yet another example, the model input 210 may be an operating parameter and/or operating condition associated with the ESP at some earlier time. The deep learning model 202 may have feedback and/or storage which provides the operating parameters or operating condition output by the deep learning model 202 at some earlier time as an input into the deep learning model 202.

The goal set 212 may indicate desired operating conditions of the ESP which are considered ideal or optimum. Examples would be flow rate at well head, intake pressure, motor temperature, power consumption, and other measurements that indicate how the ESP should operate. The goal set 212 would be input into the deep learning model so that the deep learning model 202 can generate outputs for controlling the ESP to meet the desired operating conditions in the goal set.

The classification state 214 may indicate a state of the ESP. The state of the ESP may be based on operating conditions 204. For example, the operating conditions 204 might be motor temperature, motor current, and intake pressure which indicate the classification state of the ESP such as being in a "gas locked" state. Further, a group of ESPs may be defined each of which has a same classification state and all of the ESPs in this group would be assigned an annotation that describes their classification state such as being in a "gas locked" state.

The deep learning model 202 generates one or more outputs 216 based on the model input 210. The output 216 of the deep learning model 202 may take a variety of forms including operating parameters, operating conditions, and/or a classification state of an ESP associated with controlling the ESP to meet fluid production goals of the wellbore and well system, with minimal downtime due to failure of an ESP.

The operating parameters output by the deep learning model 202 may be associated with operation of the ESP that impact drive settings of the motor like frequency setpoint, operation mode (gas lock, draw down, etc.), Volts/Hz ratio, and other settings. Operating parameters describe the settings that govern how the ESP runs and can be directly changed by the motor controller. Operating parameters are in contrast to operating conditions output by the deep learning model 202 which describe the environment that the ESP is operating in and might not be directly affected by the motor controller. The operating parameters may impact how long an ESP should pump fluid, at which rate, motor speed etc. to meet fluid production objectives. Changing operating parameters of the ESP based on the operating parameters output by the deep learning model 202 can indirectly or directly change operating conditions. An example of this would be that a change in the motor frequency (operating parameter) would lower motor current (operating condition), lower motor temperature (operating condition), and raise intake pressure (operating condition). In this regard, the operating parameters output by the deep learning model 202 may be used to control fluid production by the well system. Operating parameters of the ESP based on the operating parameters output by the deep learning model 202 would be adjusted to attain the desired operating conditions (e.g., specified by goal data) and confirmed by the actual measurement data and/or deep learning model 202.

In one or more examples, the deep learning model 202 may output an operating condition associated with health of the ESP. For example, if pressure and/or temperature measured by the sensors in the wellbore over time increases and is greater than given pressure/temperature goal data, then the deep learning model 202 may indicate that the ESP is in a gas lock and not healthy. Alternatively, if pressure and/or temperature measured by the sensors in the wellbore over time remains constant over time and within a range of the goal data, then the deep learning model 202 may indicate that the ESP is healthy.

In one or more examples, the deep learning model 202 may use the supervisory input to output the operating parameter of an ESP. For example, the supervisory input may indicate whether the ESP is healthy or not. The deep learning model 202 will correlate this input with other inputs to determine the operating parameter of the ESP, where the supervisory input may influence the determination of the operating parameter. The supervisory input may be used in other ways as well.

In one or more examples, the deep learning model 202 may not only output a current operating condition. The deep learning model 202 may output a prediction of an operating condition at some future time. To illustrate, the deep learning model 202 may indicate the operating condition such as flow rate or gas lock an hour, day, or week in the future. This prediction may be used to know the operating condition before it becomes an actual operating condition so that changes in ESP operation such as adjustment of operating parameters of the ESP may be made. The deep learning model may use inputs 204-214 in other ways as well to determine the output 216.

Figure 3:
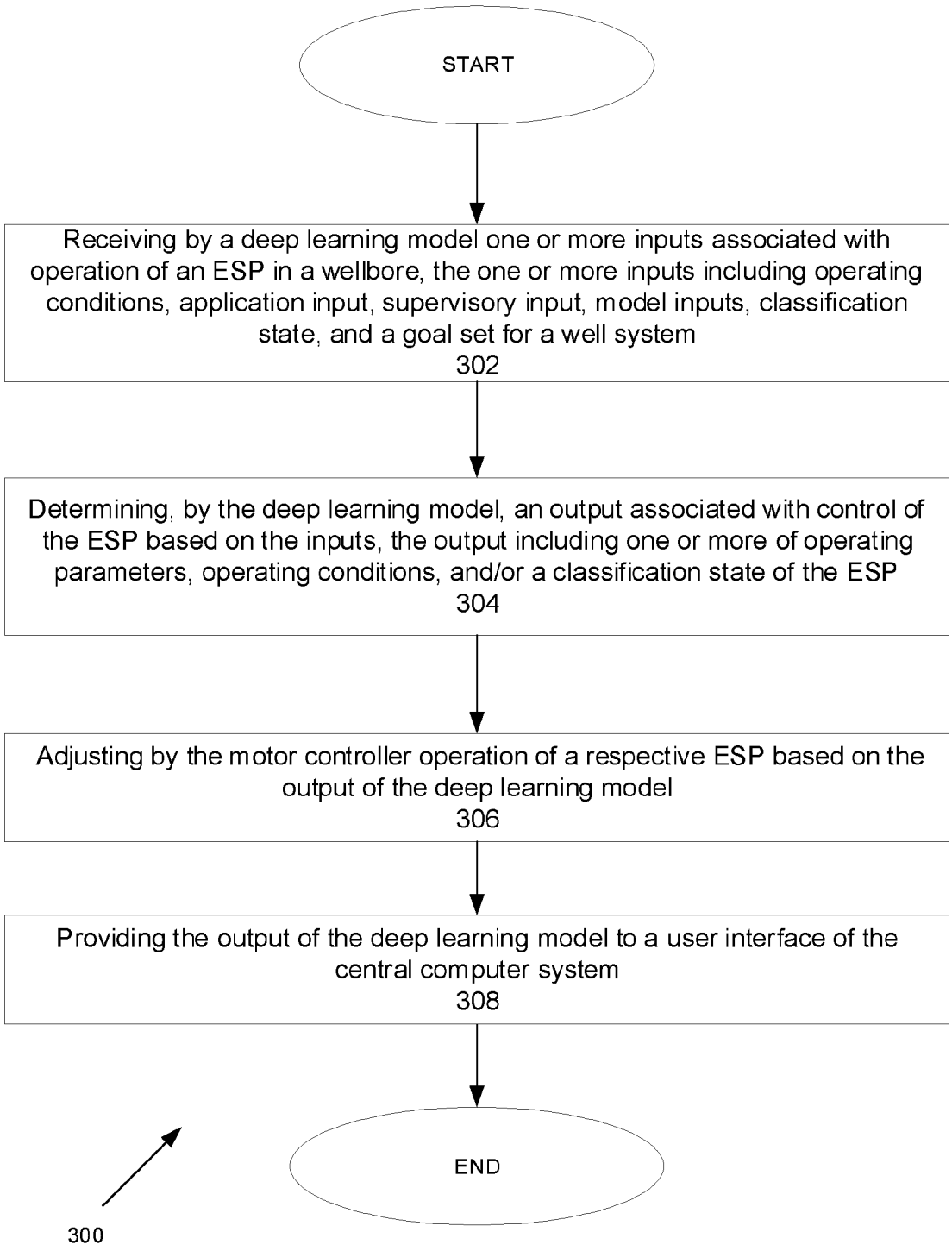
FIG. 3 is a flow chart of functions associated with operation of the deep learning model.

FIG. 3 is a flow chart 300 of functions associated with operation of the deep learning model. The deep learning model may be running on one or both of the motor controller and centralized computer system of the well system.

At 302, input data associated with operation of an ESP may be received by a deep learning model. The deep learning model may receive the input data via one or more of the communication network and/or sensors. The input data may take various forms including one or more of operating conditions, application input, supervisory input, model inputs, a goal set, and a classification state.

The deep learning model models flows and geologic properties of a specific well/reservoir and/or determines operating parameters or operating conditions for a specific type ESP. At 304, the deep learning model may determine an output associated with control of the ESP based on the one or more input data associated with meeting fluid production goals of the wellbore and well system, with minimal downtime due to failure of an ESP. The output may take the form of one or more of operating parameters, operating conditions, and/or a classification state of an ESP.

At 306, operation of the ESP may be adjusted based on the output. For example, the operating condition output may indicate that an ESP is gas locked. The motor controller changes an operating mode of the ESP to Gas Lock mode so that a motor speed of the ESP is reduced. As another example, the operating condition output may indicate a flow rate at the well head. The flow rate may be lower than expected which causes the motor controller to adjust the frequency setpoint of the ESP to increase flow rate at the well head. The ESP in turn increases speed of the motor to pump more fluid.

The operating parameters output may produce not only a desired change in fluid production of a given ESP but also a desired change in fluid production by the reservoir. For example, the operating parameters output may be used to adjust operation of an ESP such as a motor speed to change a fluid production level in the reservoir immediately or in the future. Operation of the ESPs may be adjusted to meet other fluid production goals as well. For example, if the operating condition output is fluid production of reservoir which does not meet production goals in a month, the operating condition output may be used to control the ESPs to increase pumping to meet the production goals. A motor speed of the motor associated with the ESP may be increased to increase the pumping. As another example, if the operating condition output is fluid production of reservoir which exceeds production goals in a month, the ESPs may be controlled to reduce pumping to meet the production goals. A motor speed of the motor associated with the ESP may be decreased to decrease the pumping. As another example, if the operating condition output indicates flow rate is more or less than a threshold amount, the speed of the ESP may be increased or decreased to increase or decrease a flow rate, respectively.

In one or more examples, the deep learning model may not only output a current operating condition. The deep learning model may output a prediction of an operating condition at some future time. To illustrate, the deep learning model may output an operating condition such as flow rate or gas lock an hour in the future or a day in the future. This output may be used to know operating conditions before it becomes an actual operating condition so that changes in ESP operation may be made.

At 308, the output may be provided to a user interface of the central computer system (e.g., display and/or input/output device such a keyboard, mouse, etc.). Engineering personnel may assess operation of the ESP based on the output. For example, the human interface may display a history of the output over time so that the engineering personnel can track operation of the ESP and fluid production over time.

The deep learning model may be used to control the ESP in a centralized or distributed manner with respect to the well system.

Figure 4:
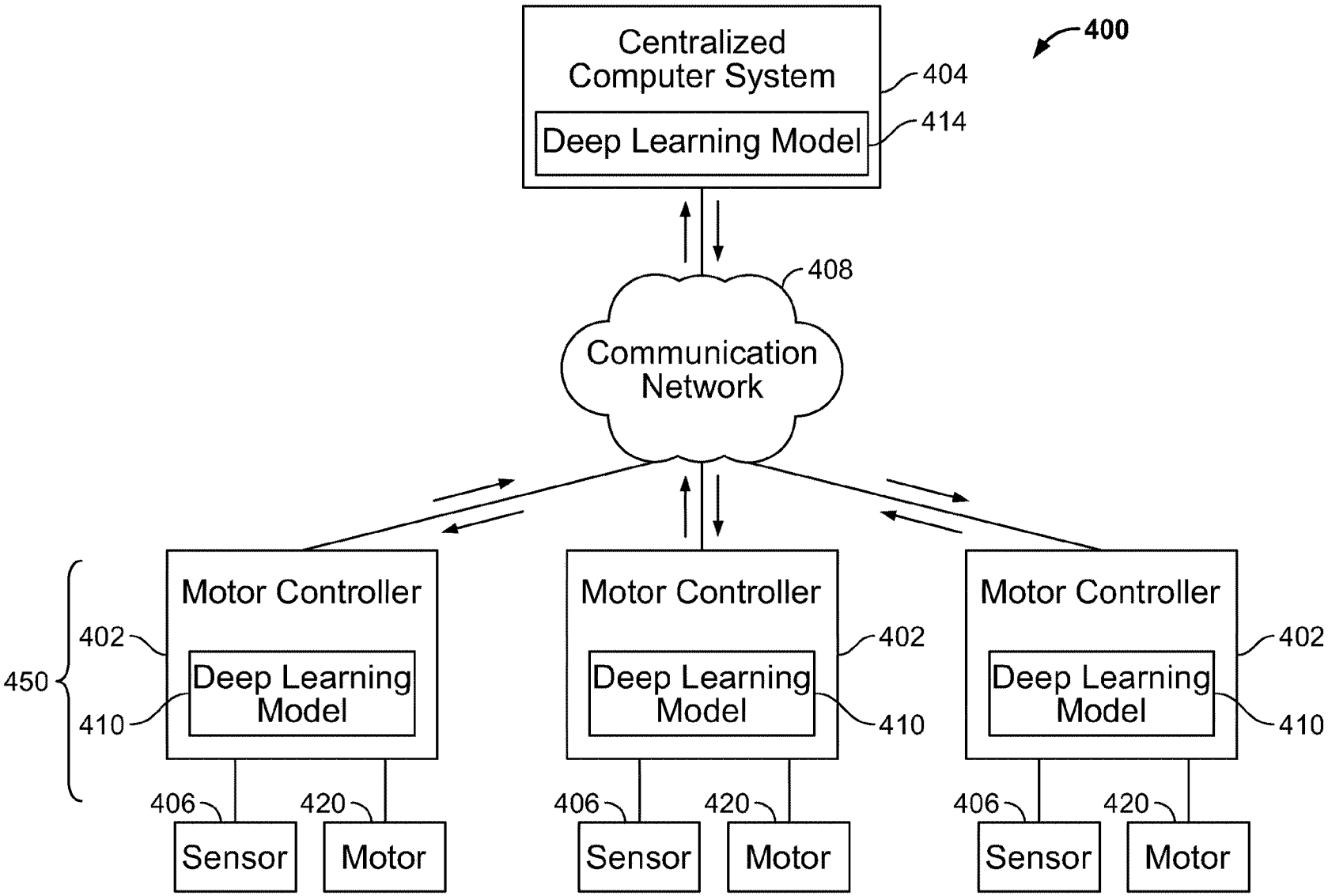
FIG. 4 is a block diagram associated with centralized control of ESPs.

FIG. 4 is a simplified block diagram 400 of components associated with centralized control of the ESPs 450. The block diagram 400 includes an ESP 450 having a motor 420, a motor controller 402 which controls the motor 420, the centralized computer system 404, and the plurality of sensors 406. The motor controller 402 and centralized computer system 404 may be communicatively coupled together via the communication network 408, where the arrows show direction of communication between various components.

The motor controller 402 and centralized computer system 404 may have respective deep learning models 410, 414. The deep learning model 410, 414 may receive various inputs including one or more operating conditions, application input, supervisory input, model inputs, and a goal set. The inputs may be received from one or more of an ESP 450, sensor 406, centralized computer system 404, or another input. The deep learning model 410 may be adjunct to the deep learning model 414 (referred to herein as "adjunct deep learning model") in that it assists the deep learning model 414 to control the motor controller 402 but is not permitted control the ESP 450 itself.

The centralized control of the ESP 450 implies that the centralized computer system 404 outputs one or more of the operating parameters, operating conditions, and/or a classification state which govern control of the ESP 450. The outputs are provided to a motor controller 402 of an ESP 450 via the communication network 408 which uses the outputs to adjust operation of the motor 420 of the ESP 450.

For example, if the centralized computer system 404 outputs operating parameters, then the motor controller 402 then adjusts operation of its respective motor 420 based on the operating parameters provided by the centralized computer system to meet certain fluid production goals. As another example, the motor controller 402 may determine operating parameters for the ESP 450, but these operating parameters are provided to the centralized computer system 404 rather than being executed directly by the motor controller 402 to adjust operation of its respective motor 420. The centralized computer system 404 may adjust these operating parameters and provide the adjusted operating parameters back to the motor controller 402 of the ESP 450 to adjust operation of its respective motor 420. As yet another example, if the centralized computer system 404 outputs operating conditions, the motor controller 402 associated with the ESP 450 would input the operating conditions into a deep learning model 410 which outputs operating parameters. These operating parameters may be then executed by the motor controller 402 to adjust operation of its respective motor 420. As another example, if the centralized computer system 404 outputs a classification state (e.g., a Gas Lock), the motor controller 402 associated with the ESP 450 would adjust operating parameters of the motor 420 based on this state. In this regard, the operating conditions and/or classification state output by the centralized computer system 404 controls the operating parameters determined by the deep learning model 410. Other examples are also possible for controlling the ESP 450.

By the centralized computer system 404 determining the operating parameters, operating conditions, and/or a classification state, the computational loads on each motor controller 402 is reduced. The centralized control allows for intensive computations associated with determining operating parameters being performed on the centralized computer system 404 which is more capable than the motor controller 402. Also, the centralized control allows for accurate control of the ESPs to achieve reservoir fluid production goals. The centralized control controls an ESP based on knowledge of the reservoir and how decisions with respect to fluid production of one wellbore will affect fluid production goals of another wellbore to achieve the reservoir fluid production goals.

Figure 5:
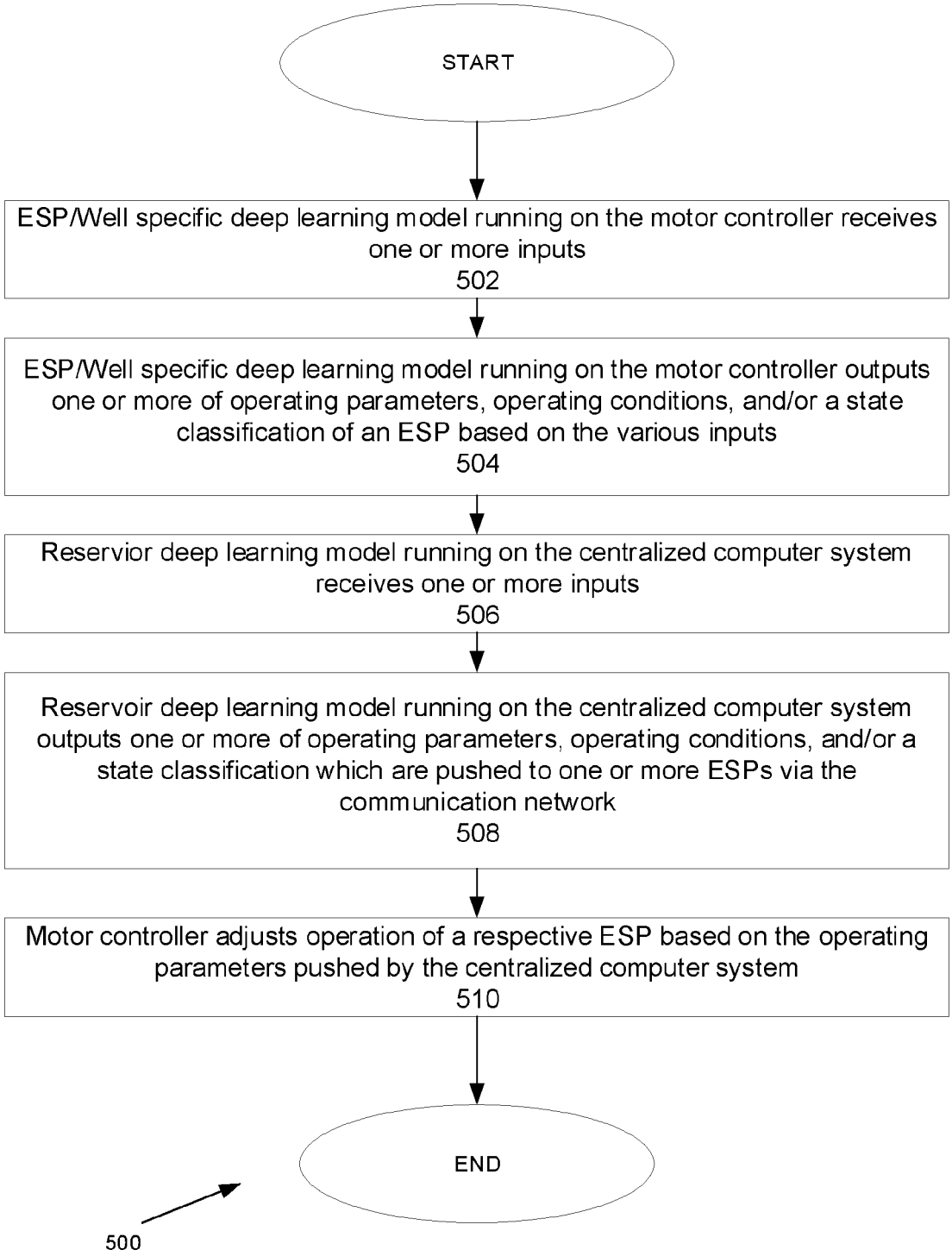
FIG. 5 is a flow chart of example functions associated with centralized control of the ESPs.

FIG. 5 is a flow chart 500 of example functions associated with centralized control of the ESPs when the motor controller and centralized computer system are running respective deep learning models. In these examples, the deep learning model associated with the centralized computer system may be referred to as a reservoir model. The reservoir model (also referred to herein as a field model) is a deep learning model describing fluid flows and geologic properties among a plurality of wellbores in which the ESPs are deployed and properties of reservoir rocks that connect those wellbores. The reservoir model is distinguishable from the deep learning model running on the motor controller which may model flows and geologic properties of a specific well and/or determines operating parameters for a specific type ESP. The deep learning model running on the motor controller is an ESP/wellbore specific deep learning model which operates adjunct to the reservoir model.

At 502, the ESP/wellbore specific model running on the motor controller may receive one or more inputs. The one or more inputs includes one or more of operating conditions, application input, supervisory input, model inputs, classification state, and a goal set received via the communication network or by the sensors.

At 504, the ESP/wellbore specific model running on the motor controller may output one or more of operating parameters, operating conditions, and/or a classification state of an ESP based on the various inputs. The ESP/wellbore specific model may model behavior of the wellbore associated with the motor controller.

At 506, the reservoir model running on the centralized computer system may receive one or more inputs. The one or more inputs into this reservoir model may include the operating conditions, application input, supervisory input, model inputs, and a goal set. The inputs may be received via from the ESP/wellbore specific model running on the motor controller, sensors, and/or the centralized computer system itself.

At 508, the reservoir model running on the centralized computer outputs one or more of operating parameters, operating conditions, and/or a classification state of an ESP which are pushed to one or more ESPs via the communication network. For example, the reservoir model miming on the centralized computer system may determine operating parameters which are output based on the one or more inputs. In one or more examples, the reservoir model running on the centralized computer system may refine and/or confirm the operating parameters provided by the motor controller based on the other inputs to generate the operating parameters which are output to the ESP.

At 510, the motor controller may adjust operation of a respective ESP based on the outputs pushed by the centralized computer system. For example, the operating condition output may indicate that an ESP is gas locked. The motor controller changes an operating mode of the ESP to Gas Lock mode so that a motor speed of the ESP is reduced. As another example, the operating condition output may indicate a flow rate at the well head. The flow rate may be lower than expected which causes the drive controller to adjust the frequency setpoint of the ESP to increase flow rate at the well head in the future. The ESP in turn increases speed of the motor to pump more fluid. As yet another example, the operating condition may be input into the deep learning model associated with the motor controller whose output is used to determine the operating parameter to control the ESP. The motor controller may adjust operation of the motor in a manner which does not damage the ESP.

To illustrate the centralized control, an adjunct model running on the motor controller may determine an operating condition of the ESP such as a fluid production level. The motor controller may send the operating condition to the centralized computer system. The centralized computer system may receive this operating condition. The reservoir model running on the centralized computer system may determine an operating parameter of the motor such as motor speed to maintain this production level and send the operating parameter to the motor controller. The motor controller may receive this operating parameter. The motor controller may operate the motor based on the operating parameter so long as the motor is not damaged. If running the motor at the operating parameter would damage the motor, then the motor controller will not change operation of the motor.

The operating parameters output may produce not only a desired change in fluid production of a given ESP but also a desired change in fluid production rate for the reservoir. For example, the operating parameters output may be used to adjust operation of an ESP such as a motor speed to change a fluid production level in the reservoir immediately or in the future. Operation of the ESPs may be adjusted to meet other fluid production goals as well. For example, if the operating condition output is fluid production of reservoir which does not meet production goals in a month, the ESPs may be controlled to increase pumping to meet the production goals. A motor speed of the motor associated with the ESP may be increased to increase the pumping. As another example, if the operating condition output is fluid production of reservoir which exceeds production goals in a month, the ESPs may be controlled to reduce pumping to meet the production goals. A motor speed of the motor associated with the ESP may be decreased to decrease the pumping. As another example, if the operating condition output indicates flow rate is more or less than a threshold amount, the speed of the ESP may be increased to increase or decrease a flow rate, respectively. As yet another example, the production rate may be adjusted to maintain a specified reservoir pressure or motor voltage or frequency may be adjusted to maximize ESP efficiency.

In one or more examples, the deep learning model may not only output a current operating condition. The deep learning model may output a prediction of an operating condition at some future time. To illustrate, the deep learning model may output an operating condition such as flow rate or gas lock an hour in the future or a day in the future. This output may be used to know an operating condition before it becomes an actual operating condition so that changes in ESP operation may be made.

In one or more examples, the motor controller associated with an ESP may not have a deep learning model. Instead, the ESP may provide measurement data from one or more sensors to the deep learning model on the centralized computer system and receive from the centralized computer system the operating parameters, operating conditions, and/or a classification state of the ESP. The motor controller may then operate the motor based on output from the centralized computer system also without executing any deep learning model.

Figure 6:
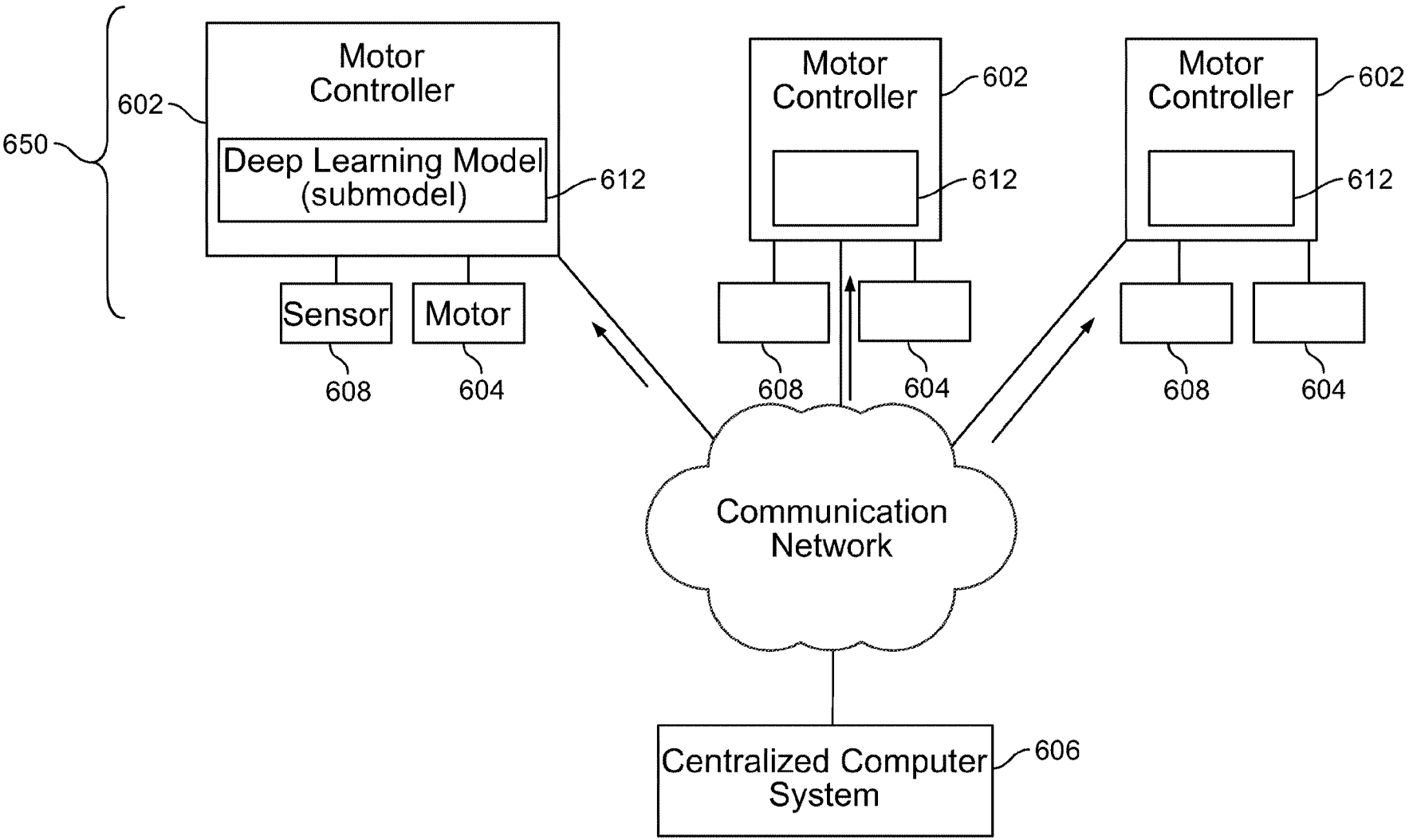
FIG. 6 is a block diagram associated with distributed control of ESPs.

FIG. 6 illustrates a simplified block diagram 600 associated with distributed control of ESPs. The block diagram includes ESPs 650 each having a motor controller 602 and respective motor 604, the centralized computer system 606, and the plurality of sensors 608. The motor controllers 602 may be communicatively coupled to the centralized computer system 606 via the communication network 610. The motor controller 602 may have a respective deep learning model 612 for determining one or more of operating parameters, operating conditions, and/or a classification state of the ESP 650 which were previously provided by the centralized computer system 606 in the centralized control example to control the ESP 650. The deep learning model running on the motor controller 602 may be referred to as a submodel or deep learning submodel. The submodel is a deep learning model corresponding to a portion of a reservoir model. The submodel models fluid flows and geologic properties of a respective wellbore. Unlike the deep learning model running on the motor controller in centralized control, the submodels have mathematical properties such that the modeling is optimized for the respective wellbore and then the separate optimizations can be combined to form a single optimization of the entire reservoir. The single optimization in one or more examples may be equivalent to the reservoir model. Further, the submodel running on the motor controller 602 in distributed control may control the ESP 650 itself compared to the deep learning model running on the motor controller in centralized control which operates adjunct to the deep learning model running on the centralized computer system control. The deep learning model running on the motor controller and centralized computer system together control the ESP in centralized control.

In this regard, the distributed control of the ESP 650 implies that one or more of operating parameters, operating conditions, and/or a classification state are determined by the motor controller 602 via a deep learning model and not the centralized computer system 606. The centralized computer system 606 may not have a deep learning model for purposes of controlling operation of the ESP 650. The motor controller 612 may determine one or more operating parameters, operating conditions, and/or a classification state for a respective ESP 650 and resulting fluid pumped by the such that computational loads on the centralized computer system 606 is reduced. Because each of the ESP 650 has a submodel, the distributed control provides fault tolerance compared to the centralized control which relies on reliable operation of the centralized computer system 606. Failure of one motor controller will still allow control of the other ESPs. The distributed control also provides quicker response time since control decisions are being performed on the ESP 650 rather than centralized computer system 606. The distributed control also uses less bandwidth since communication with the centralized computer system 606 to control the ESP 650 is less. The distributed control provides fault tolerance compared to the centralized control which relies on reliable operation of the central computer system.

The distributed control also enables fine grained control of an ESP 650. For example, the centralized computer system 606 may send updates to the submodel due to changes in well conditions which the motor controller 602 may use to update a respective submodel 612. The update may result in the submodel providing outputs which allow for better control of the ESP to meet fluid production goals. As another example, the submodel associated with a given motor controller can be updated by the given motor controller, or another motor controller may send updates to the given motor controller to update the submodel associated with the given motor controller. Other variations are also possible.

Figure 7:
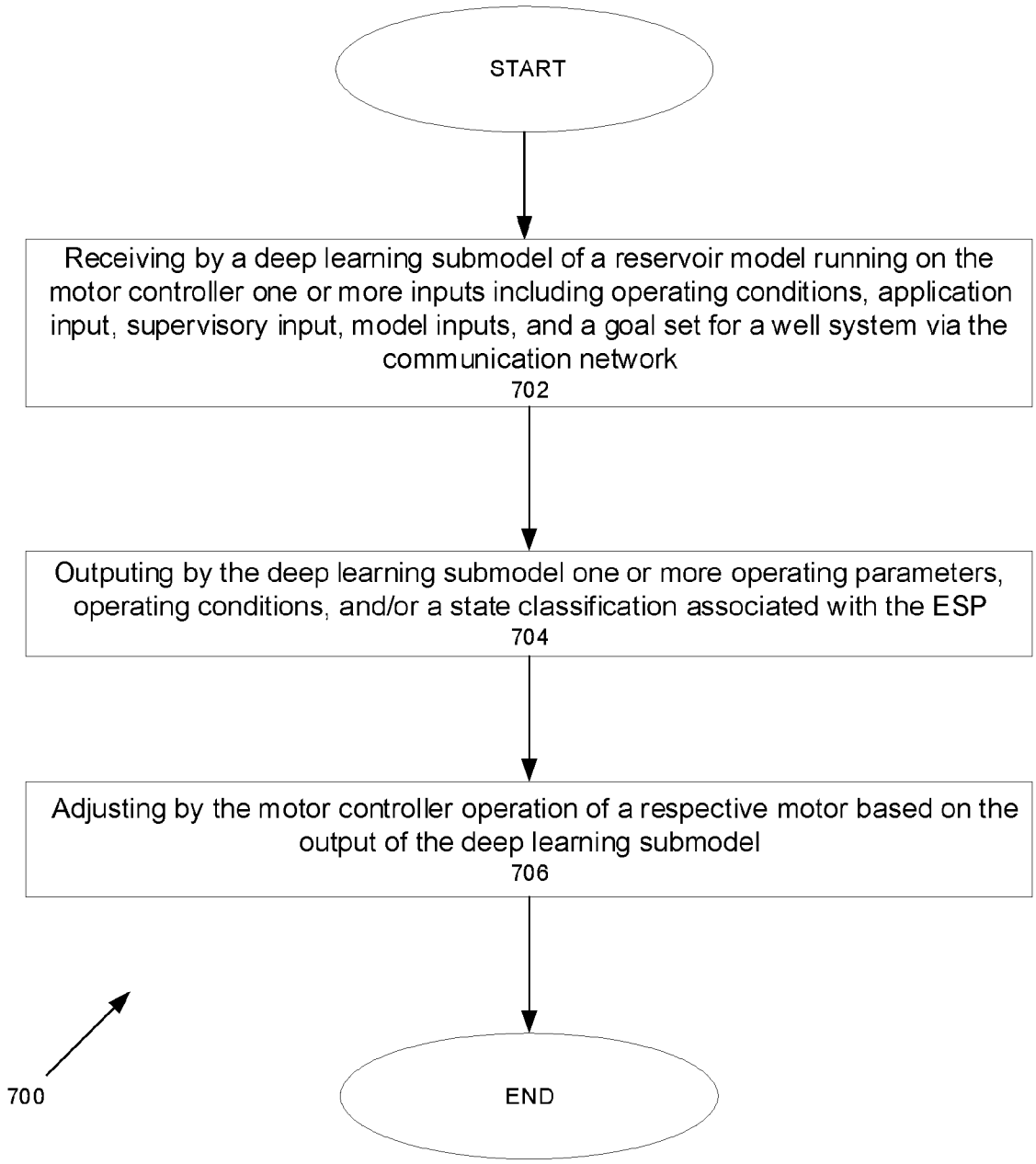
FIG. 7 is a flow chart of functions associated with distributed control of ESPs.

FIG. 7 is a flow chart of functions 700 associated with distributed control of the ESPs when the motor controller is running a respective deep learning model, i.e., submodel.

At 702, a submodel of a reservoir model running on the motor controller of an ESP may receive one or more inputs including the operating conditions, application input, supervisory input, model inputs, classification state, and a goal set via the communication network. In one or more examples, the operating conditions and/or model inputs may be received from other motor controllers running other submodels. For example, a submodel associated with a given motor controller may take as input, an output of a submodel associated with another motor controller. The application input, supervisory input, and goal set may be received from the centralized computer system via the communication network. The inputs may be received in other ways as well.

At 704, the submodel may output based on the one or more inputs, one or more operating parameters, operating conditions, and/or a classification state for controlling an ESP.

At 706, the motor controller may adjust operation of a respective motor based on the output of the submodel. With the output, operation of the ESP may be adjusted to meet fluid production goals of the wellbore in the present or in the future. Each wellbore in a well system have a motor controller which adjusts operation of a respective motor based on a submodel. In this regard, control by the plurality of motor controllers using a respective submodel may facilitate fluid production of a well system served by the plurality of wellbores. In one or more examples, the motor controller may also send the output of the submodel to the centralized computer, e.g., for tracking purposes by software running on the centralized computer system and/or by engineering personnel.

To illustrate the distributed control, a submodel running on the motor controller may determine an operating condition of the ESP such as a fluid production level. The motor controller also receives other operating conditions from other motor controllers associated with other wellbores in the reservoir. The submodel may receive as input the other operating conditions and the operating condition previously determined by the submodel to determine an operating parameter of the ESP. The motor controller may operate the motor based on this operating parameter. Additionally, the motor controller may send an indication of the operating parameter to the centralized computer system.

The motor controller and centralized computer system may have software for training the deep learning model. Based on the training, the deep learning model may output desired operating parameters, operating conditions, and/or classification state associated with the ESP based on one or more inputs for controlling the ESP to achieve the fluid production goals.

Figure 8:
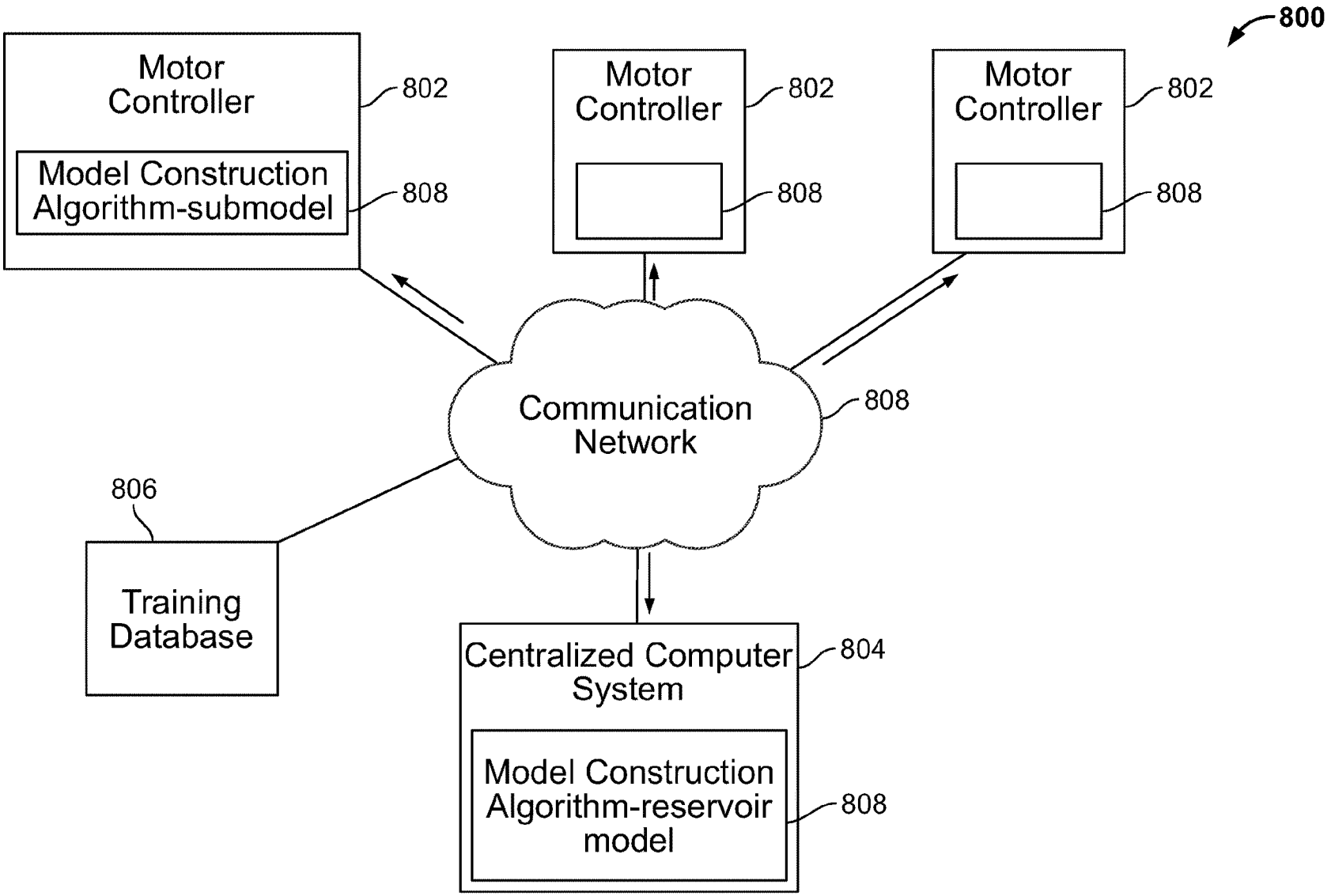
FIG. 8 is a block diagram for training the deep learning model.

FIG. 8 illustrates a simplified block diagram 800 for training the deep learning models. The block diagram 800 shows a plurality of motor controllers 802, a centralized computer system 804, and a training database 806 in communication with each other via a communication network 808 having a training dataset.

The plurality of motor controllers 802 may have software that implements model training algorithms 808 for training the deep learning models based on training data stored in the training dataset 806. The training process may use training data to train the deep learning model. The training dataset may include one or more of operating conditions, application input, supervisory input, model inputs, a goal set, and a classification state (collectively referred to as training data) for training the deep learning model. The training of the deep learning model involves splitting the training dataset stored in the training database 806 into various groups of related data to generate the deep learning model. The groups of related data may be used, for example, to weigh branches of respective neural networks which are then combined in a hierarchical fashion to define the deep learning model. The weighting of the branches results in the deep learning model modeling the well system and/or specific wellbore. Similarly, the centralized computer system 806 may have software that implements model training algorithms 808 for training the deep learning models, e.g., reservoir model, submodel, and/or ESP/well specific deep learning model (e.g., adjunct model which is not shown), based on training data stored in the training dataset 806.

Figure 9:
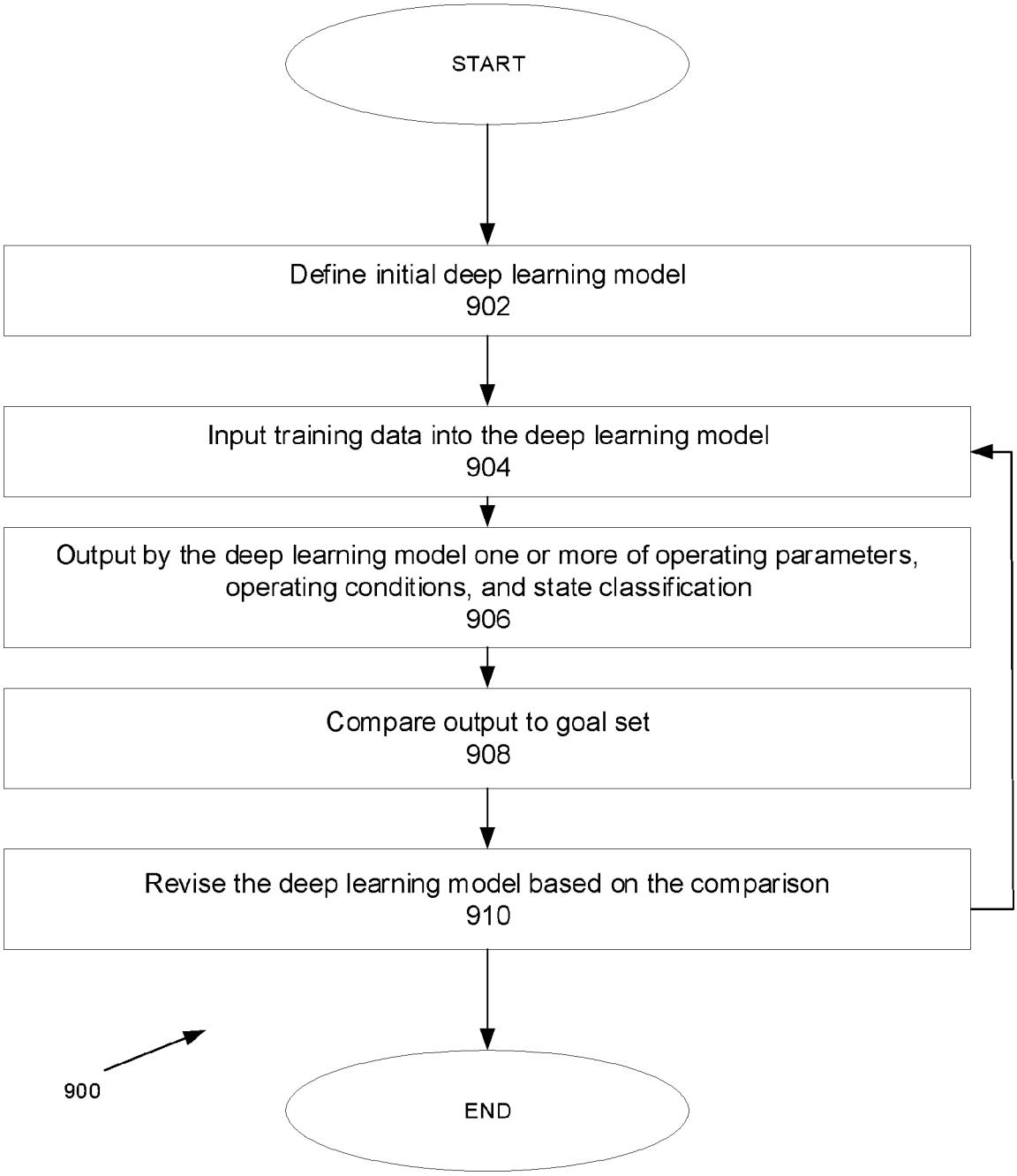
FIG. 9 is a flow chart of functions associated with training the deep learning model.

FIG. 9 is a flow chart of functions 900 associated with training the deep learning model. The deep learning model may be the submodel, ESP/well specific deep learning model, and/or reservoir model. Functions 900 may be performed by the centralized computer system in which case the training might be for the reservoir model. Alternatively, functions 900 may be performed by the motor controller in which case the training is for the submodel and/or ESP/well specific deep learning model. In one or more examples, the submodel and/or ESP/well specific deep learning model may be trained on the centralized computer system and then sent to the respective motor controller to control the ESP.

At 902, an initial deep learning model may be defined. The initial deep learning model may be a neural network with more than two hidden layers. The initial deep learning model may have default weights associated with the neural network which is to be adjusted via a training process. At 904, the training dataset may be input into the initial deep learning model. At 906, the deep learning model may output one or more of operating parameters, operating conditions, and a classification state. In the case, that the actual ESP is being controlled, the deep learning model may be trained in real time with data from actual well operations. In the case, that the simulated ESP is being controlled, the deep learning model may be trained offline with the data from the simulated well operation. At 908, the output is compared to the goal set. At 910, revisions of deep learning model may be made, e.g. by adaptation of the neural network associated with the deep learning model, in an iterative process to refine the deep learning model by the comparison of the output to the goal data. For example, the comparison may be classified in terms of a level of match such as correlation. If the correlation is less than a threshold amount, further analysis may be undertaken, e.g. the deep learning model may be adapted by adjusting the weights of the neural network, either by the model itself or by another process or by human intervention until the output matches the goal data. The training data may be input into the deep learning model and steps 904 to 910 iteratively carried out until the output matches the goal data. Further, the model training process may be performed in a piecewise manner where the deep learning model may be adapted based on splitting the training data into various groups of related data and using the split training data to adapt the model. Other model training algorithms may also be used.

Further, the deep learning models may be updated periodically or continuously based on updated training data. The updated training data may include recent measurement data from the sensors and goal data that reflects the equipment conditions and/or downhole conditions as a result of pumping fluid from the reservoir. The more than two layers of the deep learning model allow for modeling the changing conditions in the wellbore over time. This way the deep learning model continue to adapt to changing conditions in the wellbore so that the ESPs are accurately controlled to meet fluid production goals.

In one or more examples, the central computer system may send submodel updates via the communication network to the motor controller at given intervals of time. The submodel updates may cause a submodel associated with a given wellbore to be updated to account for changes in well conditions that might impact operating parameters output by the submodel. In other cases, the submodel associated with a given motor controller can be updated by the given motor controller, or another motor controller may send updates to the given motor controller to update the submodel associated with the given motor controller. In yet other cases, the centralized computer system may also collect the submodels running on each of the motor controllers via the communication network which are combined to form a reservoir model, for reporting or monitoring purposes to engineering personnel via the centralized computer system.

Figure 10:
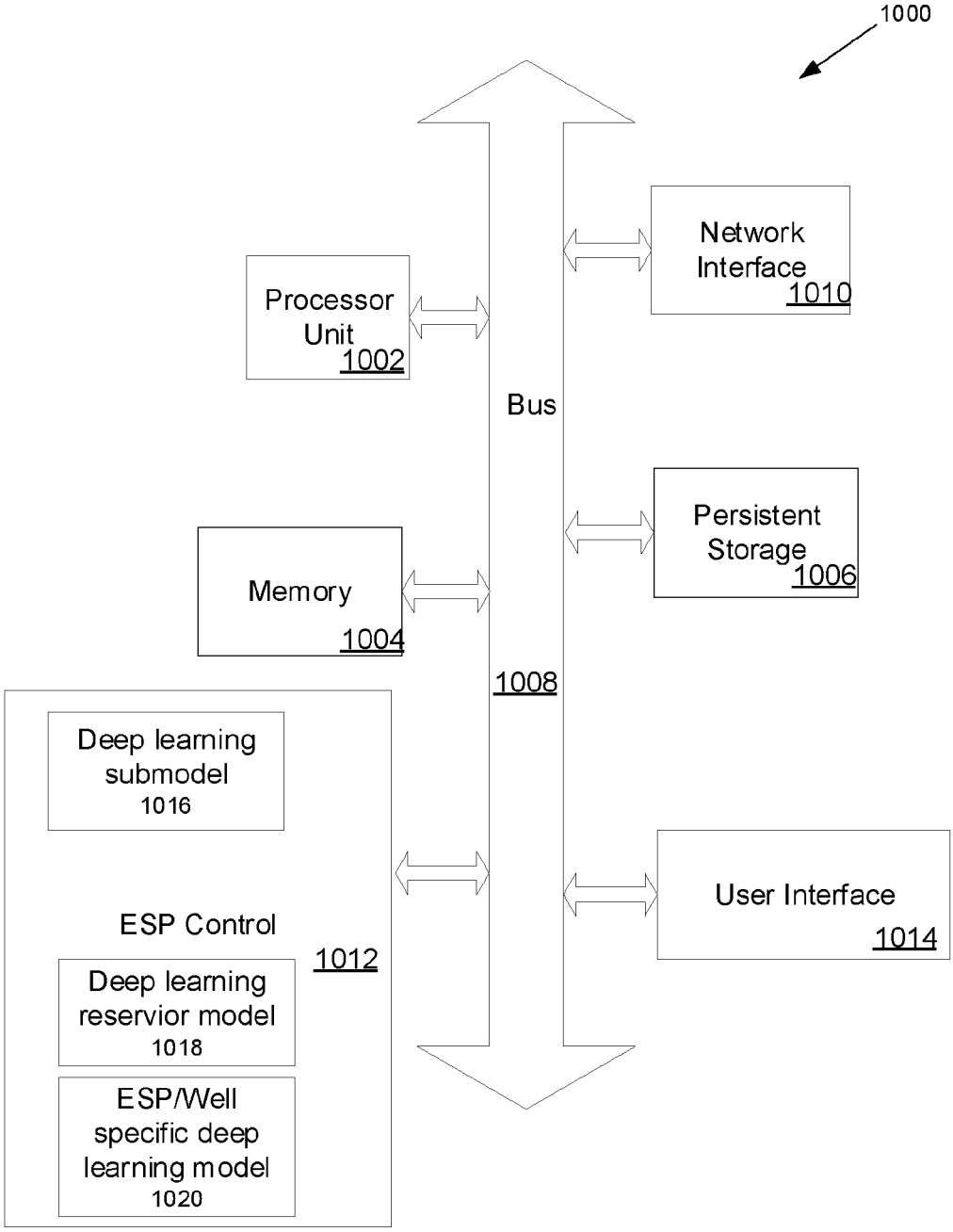
FIG. 10 is a block diagram of a system for controlling operation of one or more ESPs.

FIG. 10 is a block diagram of apparatus 1000 (e.g., the centralized computer system and/or motor controller) for controlling operation of one or more ESPs. The apparatus 1000 includes a processor 1002 (possibly including multiple processors, multiple cores, multiple nodes, and/or implementing multi-threading, etc.). The apparatus 1000 includes memory 1004. The memory 1004 may be system memory (e.g., one or more of cache, SRAM, DRAM, zero capacitor RAM, Twin Transistor RAM, eDRAM, EDO RAM, DDR RAM, EEPROM, NRAM, RRAM, SONOS, PRAM, etc.) or any one or more other possible realizations of machine-readable media.

The apparatus 1000 may also include a persistent data storage 1006. The persistent data storage 1006 can be a hard disk drive, such as a magnetic storage device which stores one or more of operating conditions, application input, supervisory input, model inputs, and a goal set. The computer system also includes a bus 1008 (e.g., PCI, ISA, PCI-Express) and a network interface 1010 in communication with the other ESPs and/or central computer system. The apparatus 1000 may have ESP control 1012 with an ESP/well specific deep learning model 1016, deep learning reservoir model 1018, and/or deep learning submodel 1020 which receives one or more inputs and outputs one or more operating conditions, operating parameters, and/or classification state to facilitate control of an ESP as described above.

The apparatus 1000 may further comprise a user interface 1014. The user interface 1014 may include a display such as a computer screen or other visual device to show operating parameters, operating conditions, classifications etc. associated with an ESP for review by engineering personnel. The user interface 1014 may also include an input device such as a mouse, keyboard. In the case that the apparatus 1000 is a centralized computer system, the input device may receive the supervisory input and/or application input from engineering personnel. Other types of input may also be received.

The apparatus 1000 may implement any one of the previously described functionalities partially (or entirely) in hardware and/or software (e.g., computer code, program instructions, program code) stored on a machine readable medium/media. In some instances, the software is executed by the processor 1002. Further, realizations can include fewer or additional components not illustrated in FIG. 10 (e.g., video cards, audio cards, additional network interfaces, peripheral devices, etc.). The processor 1002 and the network interface 1010 are coupled to the bus 1008. Although illustrated as being coupled to the bus 1008, the memory 1004 can be coupled to the processor 1002.

The functionality of the motor controller and centralized computer system described above is exemplary in nature. Specific functionality of the motor controller and centralized computer system may depend on a level by which the control of the ESP is centralized or distributed. A more distributed system will have more functionality for determining how the ESP is controlled on the motor controller, with a fully distributed system having all of the functionality on the controller, while a more centralized system will have more functionality on the centralized computer system and less on the motor controller, with the other extreme being a motor controller that simply executes operations given by the centralized computer system. Also, in some instances, the motor controller might have a well-specific deep learning model, a submodel derived from a field or reservoir model, or no model at all. Yet other variations are also possible.

An adjunct deep learning model is described as operating on the motor controller in centralized control of the ESP. In one or more examples, a submodel may operate on the motor controller in centralized control instead of or in addition to the adjunct deep learning model. The submodel may receive an operating parameter from the centralized computer system and change the operating parameter to avoid damage to the ESP. As another example, the submodel may receive an operating condition from the centralized computer system and determine an operating parameter for the ESP based on the operating condition.

In one illustration, the reservoir model running on the centralized computer system may determine an operating parameter of the ESP such as operate the motor at a speed of 65 Hz. The centralized computer system may send this operating parameter to the motor controller. The submodel running on the motor controller may receive this operating parameter and determine that a speed of 65 Hz would damage the motor. The submodel may decide to reduce the speed to 60 Hz and the motor controller may causes the motor to operate at that speed. The submodel may be able to override the operating parameter sent by the centralized computer system, unlike the adjunct model which might not be able to override an operating parameter sent by the centralized computer system. In some instances, the motor controller may also send a message to the centralized computer system informing it that the speed was reduced.

In another illustration, the reservoir model running on the centralized computer system may determine an operating condition of the ESP such as increase fluid production by 10%. The centralized computer system may send this operating condition to the motor controller. The motor controller may receive this operating condition. The submodel running on the motor controller may determine a speed of the motor which will achieve the increase in the fluid production and cause the motor to operate at that speed. The submodel may be able determine the operating parameter unlike the adjunct model which might not be able to determine the operating parameter based on an operating condition. The motor controller may operate the motor based on the operating parameter. In some instances, the motor controller may also send a message to the centralized computer system informing it of the speed at which the motor is running.

The flowcharts are provided to aid in understanding the illustrations and are not to be used to limit scope of the claims. The flowcharts depict example operations that can vary within the scope of the claims. Additional operations may be performed; fewer operations may be performed; the operations may be performed in parallel; and the operations may be performed in a different order. It will be understood that each block of the flowchart illustrations and/or block diagrams, and combinations of blocks in the flowchart illustrations and/or block diagrams, can be implemented by program code. The program code may be provided to a processor of a general purpose computer, special purpose computer, or other programmable machine or apparatus.

As will be appreciated, aspects of the disclosure may be embodied as a system, method or program code/instructions stored in one or more machine-readable media. Accordingly, aspects may take the form of hardware, software (including firmware, resident software, micro-code, etc.), or a combination of software and hardware aspects that may all generally be referred to herein as a "circuit," "module" or "system." The functionality presented as individual modules/units in the example illustrations can be organized differently in accordance with any one of platform (operating system and/or hardware), application ecosystem, interfaces, programmer preferences, programming language, administrator preferences, etc.

Any combination of one or more machine readable medium(s) may be utilized. The machine readable medium may be a machine readable signal medium or a machine readable storage medium. A machine readable storage medium may be, for example, but not limited to, a system, apparatus, or device, that employs any one of or combination of non-transitory electronic, magnetic, optical, electromagnetic, infrared, or semiconductor technology to store program code. More specific examples (a non-exhaustive list) of the machine readable storage medium would include the following: a portable computer diskette, a hard disk, a random access memory (RAM), a read-only memory (ROM), an erasable programmable read-only memory (EPROM or Flash memory), a portable compact disc read-only memory (CD-ROM), an optical storage device, a magnetic storage device, or any suitable combination of the foregoing. In the context of this document, a machine readable storage medium may be any tangible medium that can contain, or store a program for use by or in connection with an instruction execution system, apparatus, or device. A machine readable storage medium is not a machine readable signal medium.

A machine readable signal medium may include a propagated data signal with machine readable program code embodied therein, for example, in baseband or as part of a carrier wave. Such a propagated signal may take any of a variety of forms, including, but not limited to, electromagnetic, optical, or any suitable combination thereof. A machine readable signal medium may be any machine readable medium that is not a machine readable storage medium and that can communicate, propagate, or transport a program for use by or in connection with an instruction execution system, apparatus, or device.

Program code embodied on a machine readable medium may be transmitted using any appropriate medium, including but not limited to wireless, wireline, optical fiber cable, RF, etc., or any suitable combination of the foregoing.

Computer program code for carrying out operations for aspects of the disclosure may be written in any combination of one or more programming languages, including an object oriented programming language such as the Java® programming language, C++ or the like; a dynamic programming language such as Python; a scripting language such as Perl programming language or PowerShell script language; and conventional procedural programming languages, such as the "C" programming language or similar programming languages. The program code may execute entirely on a stand-alone machine, may execute in a distributed manner across multiple machines, and may execute on one machine while providing results and or accepting input on another machine.

The program code/instructions may also be stored in a machine readable medium that can direct a machine to function in a particular manner, such that the instructions stored in the machine readable medium produce an article of manufacture including instructions which implement the function/act specified in the flowchart and/or block diagram block or blocks.

While the aspects of the disclosure are described with reference to various implementations and exploitations, it will be understood that these aspects are illustrative and that the scope of the claims is not limited to them. In general, techniques for distributed and centralized control of ESPs as described herein may be implemented with facilities consistent with any hardware system or hardware systems. Many variations, modifications, additions, and improvements are possible.

Plural instances may be provided for components, operations or structures described herein as a single instance. Finally, boundaries between various components, operations and data stores are somewhat arbitrary, and particular operations are illustrated in the context of specific illustrative configurations. Other allocations of functionality are envisioned and may fall within the scope of the disclosure. In general, structures and functionality presented as separate components in the example configurations may be implemented as a combined structure or component. Similarly, structures and functionality presented as a single component may be implemented as separate components. These and other variations, modifications, additions, and improvements may fall within the scope of the disclosure.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

EXAMPLE EMBODIMENTS

Example embodiments include the following:

Embodiment 1: A method comprising: positioning a motor of an electric submersible pump (ESP) in a wellbore; receiving measurement data from one or more sensors; determining, by a first deep learning model running on a motor controller of the ESP, first operating parameters or first operating conditions for the ESP based on the measurement data; sending, by the motor controller, the first operating parameters or first operating conditions to a centralized computer system; determining, by a second deep learning model running on the centralized computer system, second operating parameters or second operating conditions associated with the ESP based on the first operating parameters or first operating conditions; sending, by the centralized computer system, the second operating parameters or second operating conditions to the motor controller; and adjusting, by the motor controller, operation of the motor of the ESP based on the second operating parameters or second operating conditions.

Embodiment 2: The method of Embodiment 1, wherein the first and second operating parameters are different.

Embodiment 3: The method of Embodiment 1 or 2, wherein the first deep learning model is a well specific deep learning model and the second deep learning model is a reservoir model; and wherein the first deep learning model operates adjunct to the second deep learning model.

Embodiment 4: The method of any of Embodiment 1-3, wherein adjusting operation comprises adjusting a frequency setpoint of the ESP to change fluid production in the geologic formation.

Embodiment 5: The method of any of Embodiment 1-4, wherein adjusting operation comprises inputting the second operating parameters or second operating conditions into the second deep learning model which outputs third operating parameters or third operating conditions; and changing operation of the motor of the ESP based on the third operating parameters or third operating conditions.

Embodiment 6: The method of any of Embodiment 1-5, further comprising comparing the first operating parameters or first operating conditions output by the first deep learning model to goal data associated with the first deep learning model and adjusting one or more weights of a branch of the first deep learning model based on the comparison.

Embodiment 7: The method of any of Embodiment 1-6, wherein the first deep learning model is a neural network with more than two hidden layers.

Embodiment 8: The method of any of Embodiment 1-7, further comprising sending, by the centralized computer system, an update to the second deep learning model.

Embodiment 9: The method of any of Embodiment 1-8, wherein the second operating condition is a future operating condition associated with fluid production in the geologic formation determined by the second deep learning model.

Embodiment 10: A system comprising: one or more sensors; an ESP comprising a motor; a centralized computer; program code stored in memory and executable by a processor on the ESP to perform the functions of: receiving measurement data from the one or more sensors; determining, by a first deep learning model running on a motor controller of the ESP, first operating parameters or first operating conditions for the ESP based on the measurement data; sending, by the motor controller, the first operating parameters or first operating conditions to the centralized computer system; and adjusting, by the motor controller, operation of the motor of the ESP based on second operating parameters or second operating conditions associated with the ESP received from the centralized computer; program code stored in memory and executable by a processor on the centralized computer system to perform the functions of: determining, by a second deep learning model running on the centralized computer system, the second operating parameters or second operating conditions associated with the ESP based on the first operating parameters or first operating conditions; and sending, by the centralized computer system, the second operating parameters or second operating conditions to the motor controller.

Embodiment 11: The system of Embodiment 10, wherein the first and second operating parameters are different.

Embodiment 12: The system of Embodiment 10 or 11, wherein the first deep learning model is a well specific model and the second deep learning model is a reservoir model; and wherein the first deep learning operates adjunct to the second deep learning model.

Embodiment 13: The system of any of Embodiment 10-12, wherein the program code to adjust operation comprises program code to adjust a frequency setpoint of the ESP to change fluid production in the geologic formation.

Embodiment 14: The system of any of Embodiment 10-13, wherein the program code to adjust operation comprises program code to input the second operating parameters or second operating conditions into the second deep learning model which outputs third operating parameters or third operating conditions; and change operation of the motor of the ESP based on the third operating parameters or third operating conditions.

Embodiment 15: The system of any of Embodiment 10-14, further comprising program code to compare the first operating parameters or first operating conditions by the first deep learning model to goal data associated with the first deep learning model and adjust one or more weights of a branch of the first deep learning model based on the comparison.

Embodiment 16: The system of any of Embodiment 10-15, wherein receiving measurement data comprises receiving measurement data from a virtual sensor, the virtual sensor comprising output from a mathematical model which models multiphase fluid flow.

Embodiment 17: The system of any of Embodiment 10-16, further comprising program code to send, by the centralized computer system, an update to the second deep learning model.

Embodiment 18: The system of any of Embodiment 10-17, wherein respective sensors are positioned in respective wellbores; wherein the respective sensors output respective measurement data; and wherein the program code for determining the first operating parameters or first operating conditions for the ESP comprises program code for inputting the respective measurement data into the first deep learning model without normalization.

Embodiment 19: A method comprising: positioning a motor of an ESP in a wellbore of a reservoir; receiving measurement data from the one or more sensors; determining, by a first deep learning submodel running on a motor controller of the ESP, operating parameters or operating conditions for the ESP based on the measurement data, wherein the first deep learning submodel models the wellbore; and wherein the first deep learning submodel combined with other second deep learning submodels associated with other motor controllers of other ESPs in other wellbores of the reservoir define a reservoir model, the reservoir model modeling the reservoir; and adjusting, by the motor controller, operation of the motor of the ESP based on the operating parameters or operating conditions.

Embodiment 20: The method of Embodiment 19, further comprising receiving from a centralized computer system in communication with the motor controller, an update to the first deep learning submodel; and updating the first deep learning submodel based on the update.

What is claimed is:

1. A method comprising:

networking a plurality of electric submersible pumps (ESPs) with a centralized computing system, wherein each of the plurality of ESPs includes a motor controller and a deep learning model associated with each ESP, and wherein each of the plurality of ESPs are located in a different wellbore of a plurality of wellbores;

receiving, at the centralized computer system, predicted operating conditions for each of the different wellbores predicted by the deep learning model for each of the associated ESPs, wherein the predicted operating conditions are predicted by the associated deep learning model, based on measurement data of the associated ESP;

obtaining, from a central deep learning model executing on the centralized computing system for each of the plurality of ESPs, at least one operating parameter for the associated motor controller based on the predicted operating conditions for the different wellbores; and sending motor adjustments to at least one motor controller associated with at least one ESP of the plurality of ESPs based on the at least one operating parameter for the at least one motor controller.

2. The method of claim 1, wherein each deep learning model is unique to a wellbore in which the ESP is positioned and the central deep learning model comprises at least one of a reservoir model and a fluid flow model.

3. The method of claim 1, wherein the motor adjustments include adjusting at least one of a frequency setpoint, an operation mode, a voltage, a voltage to frequency ratio, a pump speed, motor speed, a current, a temperature, and a pressure of the ESP.

4. The method of claim 1, wherein the predicted operating condition is a future operating condition.

5. The method of claim 1, wherein each deep learning model is a deep learning model trained on a training data set associated with the associated ESP, wherein receiving the operating conditions of each ESP of the plurality of ESPs, further comprises:

determining if the predicted operating conditions match a goal set; and based on a determination that the predicted operating conditions do not match the goal set retraining each deep learning model.

6. The method of claim 1, further comprising:

based on a determination that a measure of fluid production has changed, retraining the associated deep learning model according to the changed measure of fluid production.

7. The method of claim 1, further comprising:

receiving, at the centralized computer system second operating conditions determined from a second deep learning model associated with a second ESP of the plurality of ESPs, the second operating conditions based on measurement data of at least the second ESP of the plurality of ESPs;

obtaining from the centralized deep learning model running on the centralized computing system second operating parameters based on at least the second operating conditions of the second ESP of the plurality of ESPs; and sending motor adjustments to at least the motor controller associated with at least the second ESP of the plurality of ESPs based on the second operating parameters.

8. The method of claim 1, wherein the predicted operating conditions comprise at least one of intake pressure, motor temperature, motor current, motor frequency, power consumption, ESP health indication and operation mode, wherein the operation mode comprises at least one of gas locked, gas bubbles, overheating, draw down, and normal operation, and wherein ESP health indication comprises either ESP healthy indication and ESP unhealthy indication.

9. The method of claim 4, wherein obtaining the operating parameters comprises obtaining the operating parameters based on the future operating condition.

10. The method of claim 2, wherein the reservoir model is a mathematical fluid flow model of fluid flows and geologic properties of a plurality of wellbores in which the network of the plurality of ESPs are deployed and flows and properties of reservoir rocks that connect the plurality of wellbores.

11. A system comprising:

a network of a plurality of electric submersible pumps (ESPs), wherein each of the plurality of ESPs includes a motor, a processor, a deep learning model, and at least one sensor, and wherein each of the plurality of ESPs are located in a different wellbore of a plurality of wellbores a centralized computing system networked with the network of the plurality of ESPs, the centralized computing system having installed thereon a reservoir model;

program code stored in memory and executable by the processor on each ESP of the plurality of ESPs to:

generate by a deep learning model associated with the each ESP, predicted operating conditions for each ESP based on measurement data from at the at least the one sensor associated with each ESP;

send the predicted operating conditions to the centralized computing system; and adjust operation of the motor of at least a first ESP of the plurality of ESPs based on operating parameters obtained from the central deep learning model executing on the centralized computing system;

program code stored in memory and executable by the centralized computing system to:

obtain from the reservoir model the operating parameters for at least the first ESP based on the predicted operating conditions, wherein the reservoir model is a mathematical model of fluid flows and geologic properties of a plurality of wellbores in which the network of the plurality of ESPs are deployed and flows and properties of reservoir rocks that connect the plurality of wellbores; and send the operating parameters to at least the first ESP of the plurality of ESPs.

12. The system of claim 11, wherein the program code to adjust operation of the motor comprises program code to adjust at least one of a frequency setpoint, an operation mode, a voltage, a voltage to frequency ratio, a pump speed, a motor speed, a current, a temperature, and a pressure of at least one ESP of the plurality of ESPs.

13. The system of claim 11, further comprising program code to determine if the predicted operating conditions obtained from a first deep learning model match a goal data, and based on a determination that the predicted operating conditions do not match the goal data, retrain the first deep learning model.

14. The system of claim 11, wherein the at least one sensor comprises a virtual sensor, and wherein measurement data from the virtual sensor comprises output from a mathematical model of multiphase fluid flow.

15. The system of claim 11, further comprising:

a second ESP of the plurality of ESPs;

program code stored in memory and executable by the processor of the second ESP of the plurality of ESPs to:

based on measurement data from a second sensor associated with the second ESP, obtain from a second deep learning model associated with the second ESP second operating conditions of the second ESP;

send the second operating conditions of the second ESP to the reservoir model; and adjust operation of the motor of the second ESP based on second operating parameters; and wherein the program code stored in memory and executable by the centralized computing system further comprises program code to:

obtain from the reservoir model the second operating parameters for the second ESP based on the second operating conditions of the second ESP; and send the second operating parameters to the second ESP.

16. The system of claim 15, wherein program code executable by the centralized computing system further comprises program code to determine the second operating parameters for the second ESP based on the second operating conditions of the second ESP and the predicted operating conditions of the each of the plurality of ESPs.

17. The system of claim 16, wherein the first ESP of the plurality of ESPs is positioned in a first wellbore and the second ESP of the plurality of ESPs is positioned in a second wellbore.

18. The system of claim 15, wherein program code stored in memory and executable by the centralized computing system further comprises program code to:

update the reservoir model based on at least one of the predicted operating conditions of the each of the plurality of ESPs and the second operating conditions of the second ESP.

19. A method comprising:

based on measurement data of at least one electric submersible pump (ESP) networked with a plurality of ESPs, obtaining from a first deep learning model operating conditions of the at least one ESP, wherein the first deep learning model comprises a model corresponding to a portion of a reservoir model associated with a first wellbore, wherein each of the plurality of ESPs includes a motor controller and a deep learning model associated with each ESP, and wherein each of the plurality of ESPs are located in a different wellbore of a plurality of wellbores; and adjusting, by the motor controller associated with the at least one ESP, operation of a motor of the at least one ESP based on the operating conditions;

and wherein the reservoir model is a mathematical model of fluid flows and geologic properties of a plurality of wellbores in which the network of the plurality of ESPs are deployed and flows and properties of reservoir rocks that connect the plurality of wellbores.

20. The method of claim 19, further comprising:

obtaining, from the reservoir model, second operating conditions of the at least one ESP;

determining if the operating conditions obtained from the first deep learning model match the second operating conditions obtained from the reservoir model; and based on the determination that the operating conditions do not match the second operating conditions, retraining the first deep learning model.

* * * * *